US009235994B1

(12) United States Patent
Waltersdorf

(10) Patent No.: US 9,235,994 B1
(45) Date of Patent: Jan. 12, 2016

(54) WRISTBAND ASSEMBLY WITH COVER SEAL

(71) Applicant: Artemax, Inc., Brookfield, WI (US)

(72) Inventor: Bryan Waltersdorf, Oconomowoc, WI (US)

(73) Assignee: Artemax, Inc., Brookfield, WI (US)

( * ) Notice: Subject to any disclaimer, the term of this patent is extended or adjusted under 35 U.S.C. 154(b) by 0 days.

(21) Appl. No.: 14/789,602

(22) Filed: Jul. 1, 2015

Related U.S. Application Data

(60) Provisional application No. 62/019,475, filed on Jul. 1, 2014.

(51) Int. Cl.
*G09F 3/00* (2006.01)
*G09F 3/20* (2006.01)

(52) U.S. Cl.
CPC ..... *G09F 3/005* (2013.01); *G09F 3/201* (2013.01)

(58) Field of Classification Search
CPC ..... G09F 3/005; G09F 3/201
See application file for complete search history.

(56) References Cited

U.S. PATENT DOCUMENTS

| | | | | | |
|---|---|---|---|---|---|
| 2,561,894 | A | | 7/1951 | Wallich | |
| 2,648,924 | A | | 8/1953 | Brewster | |
| 2,954,620 | A | | 10/1960 | Schneider | |
| 3,027,665 | A | | 4/1962 | St. John | |
| 3,153,869 | A | | 10/1964 | Twentier | |
| 3,197,899 | A | * | 8/1965 | Twentier | G09F 3/005 40/633 |
| 4,078,324 | A | | 3/1978 | Wiebe | |
| 4,314,415 | A | | 2/1982 | De Woskin | |
| 4,616,436 | A | * | 10/1986 | De Woskin | G09F 3/005 24/16 PB |
| 5,457,906 | A | | 10/1995 | Mosher, Jr. | |
| 5,581,924 | A | | 12/1996 | Peterson | |
| 5,700,537 | A | | 12/1997 | Instance | |
| 5,799,426 | A | | 9/1998 | Peterson | |
| 6,349,493 | B1 | | 2/2002 | Newman et al. | |
| 6,546,656 | B2 | | 4/2003 | Twentier | |
| 6,782,648 | B1 | | 8/2004 | Mosher, Jr. | |
| 6,783,830 | B2 | | 8/2004 | Cohen et al. | |
| 6,836,215 | B1 | | 12/2004 | Laurash et al. | |
| 7,240,446 | B2 | | 7/2007 | Bekker | |
| 7,752,794 | B2 | | 7/2010 | Kerlin | |
| 8,028,450 | B2 | * | 10/2011 | Landsman | G09F 3/005 40/633 |
| 2002/0073587 | A1 | * | 6/2002 | Twentier | G09F 3/005 40/633 |
| 2007/0028495 | A1 | | 2/2007 | Kotik et al. | |
| 2011/0107637 | A1 | * | 5/2011 | Bekker | A61B 19/44 40/633 |
| 2012/0037302 | A1 | * | 2/2012 | Valenti, Jr. | B32B 3/10 156/234 |

* cited by examiner

*Primary Examiner* — Gary Hoge
(74) *Attorney, Agent, or Firm* — Michael Best & Friedrich LLP

(57) ABSTRACT

The present invention provides a wristband assembly comprising a strap adapted to be formed into a loop; a translucent (e.g., transparent) cover member having a fixed portion secured (e.g., permanently adhered) to the strap and a free end unsecured to the strap, and a release member (e.g., a silicone-coated material) positioned over an inner surface of the cover member between the fixed portion and the free end. A portion of the release member is temporarily secured to the strap at a retention location spaced from the free end (e.g., by a distance of at least 1 mm, 5 mm, 10 mm, or 15 mm). In one embodiment, the assembly further includes a retention adhesive at the retention location. Preferably, the retention adhesive is permanently secured to the release member and temporarily adhered to the strap.

10 Claims, 2 Drawing Sheets

WRISTBAND ASSEMBLY WITH COVER SEAL

BACKGROUND

The present invention generally relates to wristbands, and specifically to wristbands having a translucent cover seal for covering and protecting information.

Wristbands are commonly used as a means for identifying an individual. For example, wristbands can be used to identify individuals that are authorized to be in a certain location (e.g., at a concert or a park) or to consume certain food or beverages (e.g., at a party). In addition, wristbands can be used to identify an individual (e.g., a patient in a hospital). Wristbands in hospital setting commonly include information for identifying the individual, such as printed material or bar codes.

Some wristbands are used in an environment that could subject the wristband to contaminants, such as dirt or fluids. Such contaminants can damage the wristband or make the information on the wristband difficult to read. Accordingly, some wristbands include a transparent cover seal that inhibits the information on the wristband from being exposed to the contaminants. U.S. Pat. No. 7,240,446, the content of which is hereby incorporated by reference in its entirety, discloses one such arrangement.

SUMMARY OF THE INVENTION

The present invention provides a wristband assembly comprising a strap adapted to be formed into a loop; a translucent (e.g., transparent) cover member having a fixed portion secured (e.g., permanently adhered) to the strap and a free end unsecured to the strap, and a release member (e.g., a silicone-coated material) positioned over an inner surface of the cover member between the fixed portion and the free end. A portion of the release member is temporarily secured to the strap at a retention location spaced from the free end. For example, the retention location could be at least 1 mm, 5 mm, 10 mm, 15 mm or more. In one embodiment, the assembly further includes a retention adhesive at the retention location. Preferably, the retention adhesive is permanently secured to the release member and temporarily adhered to the strap.

Other aspects of the invention will become apparent by consideration of the detailed description and accompanying drawings.

DETAILED DESCRIPTION

FIGS. 1-4 illustrate a wristband assembly 10 embodying the present invention. The wristband assembly 10 includes a strap 12 adapted to be wrapped around a person or object to be identified. The strap 12 can be made from any suitable material, such as plastic, polyurethane, or spun-bonded plastic, which is commonly sold under the trade name Tyvek.

One end of the strap 12 includes securing adhesive 14 on an inside surface of the strap 12. The adhesive allows the strap 12 to be formed into a loop and attached to itself with the adhesive surface brought into contact with an exterior surface of a different part of the strap 12, as is generally known in the art. A release tab 16, such as silicone-coated paper, is positioned over the adhesive to protect the adhesive prior to forming the strap 12 into a loop.

Figure 1:
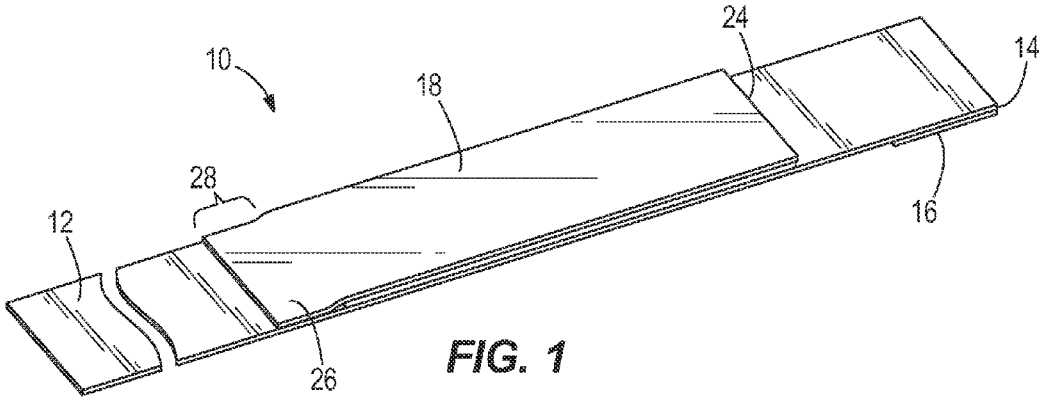
FIG. 1 is a perspective view of a wristband assembly embodying the present invention.
Figure 2:
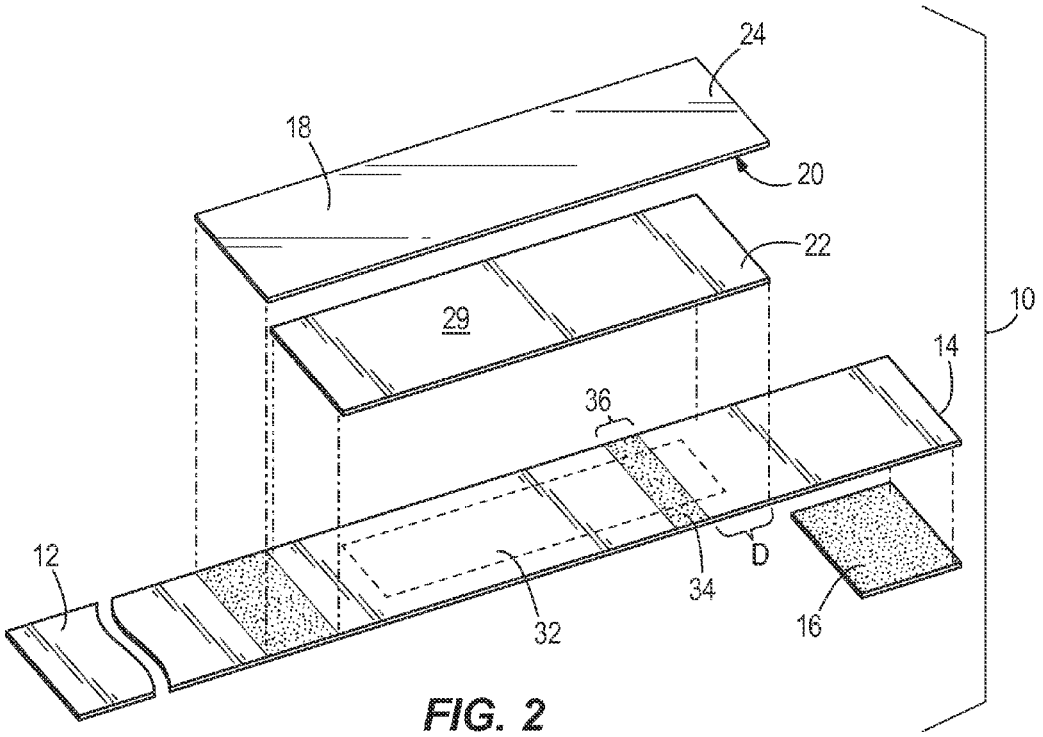
FIG. 2 is an assembly view of the wristband assembly in FIG. 1.
Figure 3:
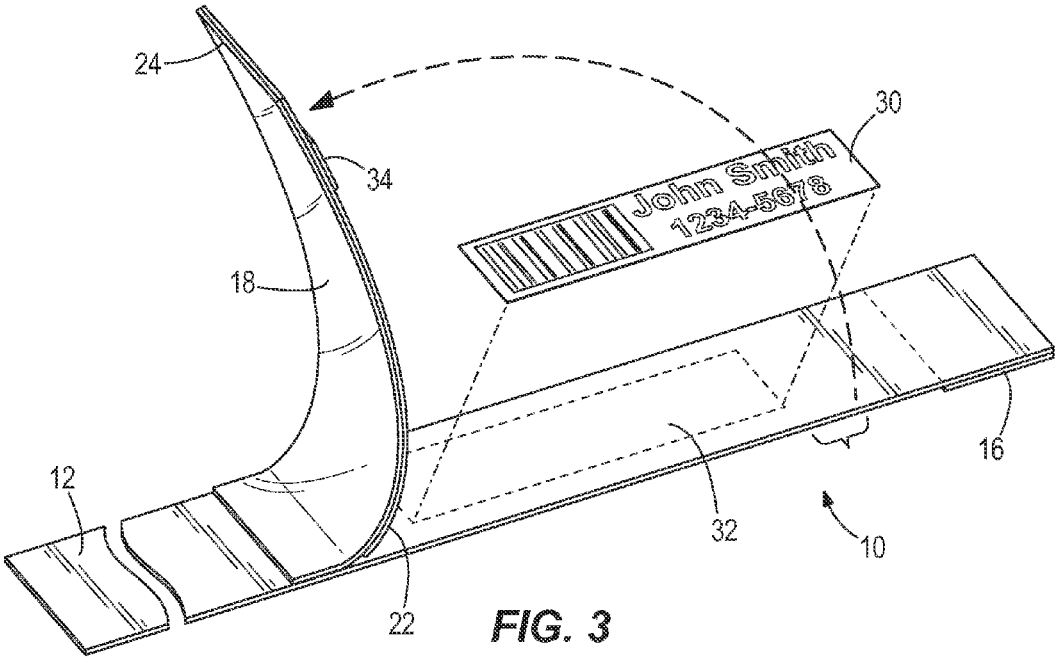
FIG. 3 is a perspective view of the wristband assembly in FIG. 1 in an open position.

A translucent cover member 18 is positioned over a portion of the outside surface of the strap 12. An inner surface 20 of the cover member 18 is provided with translucent adhesive. A release member 22 is positioned between a portion of the cover member 18 and the strap 12 to inhibit that portion of the cover member 18 (and the corresponding adhesive) from being adhered to the strap 12. The release member 22 extends from a free end 24 of the cover member 18 to a location short of a fixed end 26 of the cover member 18, such that a fixed portion 28 of the cover member 18 (and the corresponding adhesive) is allowed to contact and be adhered to the strap 12. An exterior surface 29 of the release member 22 includes a silicone coating to facilitate release of the release member 22 from the adhesive on the inner surface of the cover member 18. By virtue of this arrangement, the release member 22 is adhered to, but releasable from, the interior surface of the cover member 18. This arrangement allows the cover member 18 and release member 22 to be pivoted upwardly away from the strap 12 to facilitate positioning of an information label 30 in an information zone 32 on the exterior surface of the strap 12, as best shown in FIG. 3.

In order to inhibit pivoting of the cover member 18 and release member 22 away from the strap 12 before such movement is desired, the wristband assembly 10 further includes a retention adhesive 34 sandwiched between an interior surface of the release member 22 and an exterior surface of the strap 12 at a retention location 36 spaced from the free end. The retention adhesive 34 is designed to temporarily adhere the release member 22 and cover member 18 to the outside surface of the strap 12 prior to pivoting the cover member 18 and release member 22 away from the strap 12. In one embodiment, the retention adhesive 34 is permanently positioned on the inside surface of the release member 22, but is releasable from the outside surface of the strap 12. In light of the above-described arrangement, it can be seen that the cover member 18 and release member 22 will be held in engagement with strap 12 prior to pivoting away from the strap 12. In addition, by virtue of positioning the retention adhesive 34 spaced away from the free end 24 of the cover member 18, a portion of the free end 24 of the cover member 18 and the corresponding portion of the release member 22 will be free from adherence to the exterior surface of the strap 12, thereby making it easier for user to engage the free end 24 of the cover member 18 and corresponding portion of the release member 22 to initiate pivoting of those members away from the strap 12. The spacing of the adhesive 34 from the free end of the release member is sufficient to permit engagement of the free end by the user. For example, such spacing could be a distance D of 1 mm, 5 mm, 10 mm, 15 mm or more.

Figure 4:
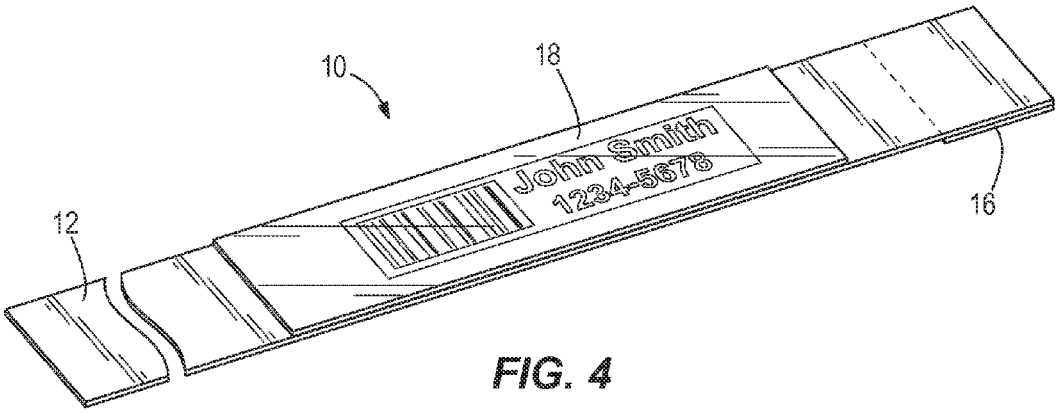
FIG. 4 is a perspective view of the wristband assembly of FIG. 1 in a closed and sealed position.

In operation, the user engages the non-adhered portion of the cover member 18 and release member 22 near the free end 24 of the cover member 18 and subsequently pulls the non-adhered portion away from the strap 12. This movement results in the temporarily-adhered portion of the release member 22 to release from the strap 12 (i.e., the retention adhesive releases from the strap) to allow the pivoting of the cover member 18 and release member 22 away from the strap 12, as shown in FIG. 3. The information label 30 can then be placed in the information zone 32, as shown in FIG. 3. The release member 22 is subsequently peeled away from the cover member 18 to expose the adhesive on the inner surface of the cover member 18. The cover member 18 is then pivoted back down towards the strap 12 to cover and provide a seal around the information label 30, as shown in FIG. 4. The release tab 16 can subsequently be removed to facilitate forming the wristband assembly 10 into a loop around a person or object to be identified.

It is noted that the drawings in this application are schematic in nature, and are not drawn to scale. Further, the use of the terms "temporarily" and "permanently" are relative terms to describe that certain connections are designed to be disconnected or not disconnected, respectively, during use. In other words, "temporarily secured" equates to a connection that is designed to be releasable without damaging the intended use of the product.

Various features and advantages of the invention are set forth in the following claims.

The invention claimed is:

1. A wristband assembly comprising:

a strap adapted to be formed into a loop;

a translucent cover member having a fixed portion secured to the strap and a free end unsecured to the strap; and a release member positioned over an inner surface of the cover member between the fixed portion and the free end, wherein a portion of the release member is temporarily secured to the strap at a retention location spaced from the free end.

2. A wristband assembly as claimed in claim 1, wherein the fixed portion of the cover member is adhered to the strap.

3. A wristband assembly as claimed in claim 1, wherein the translucent cover member is a substantially transparent cover member.

4. A wristband assembly as claimed in claim 1, wherein the release member comprises a silicone-coated material.

5. A wristband assembly as claimed in claim 1, further comprising a retention adhesive at the retention location.

6. A wristband assembly as claimed in claim 5, wherein the retention adhesive is permanently secured to the release member and temporarily adhered to the strap.

7. A wristband assembly as claimed in claim 1, wherein the retention location is spaced from the free end by a distance of at least 1 mm.

8. A wristband assembly as claimed in claim 1, wherein the retention location is spaced from the free end by a distance of at least 5 mm.

9. A wristband assembly as claimed in claim 1, wherein the retention location is spaced from the free end by a distance of at least 10 mm.

10. A wristband assembly as claimed in claim 1, wherein the retention location is spaced from the free end by a distance of at least 15 mm.

* * * * *